United States Patent [19]

Robbins

[11] Patent Number: 4,741,455

[45] Date of Patent: May 3, 1988

[54] BUSTLE GATE ASSEMBLY AND METHOD

[75] Inventor: James K. Robbins, Fayette, Ala.

[73] Assignee: Marathon Corporation, Birmingham, Ala.

[21] Appl. No.: 2,994

[22] Filed: Jan. 13, 1987

[51] Int. Cl.[4] ..... B65D 43/14; B65D 51/04

[52] U.S. Cl. ..... 220/333; 220/1 T

[58] Field of Search ..... 220/1 T, 332, 329, 333, 220/334, 344; 100/229 A, 295; 296/50; 16/163, 302

[56] References Cited

U.S. PATENT DOCUMENTS

| | | | |
|---|---|---|---|
| 653,503 | 7/1900 | Dundon | 220/344 |
| 1,418,076 | 5/1922 | Hedstrom | 16/302 |
| 2,078,003 | 4/1937 | Klein | 220/344 |
| 3,045,861 | 7/1962 | Dieter et al. | 220/344 |
| 3,066,349 | 12/1962 | Youngdale | 16/163 |
| 3,346,992 | 10/1967 | Lodge | 220/332 |
| 4,290,352 | 9/1981 | Schmidt et al. | 220/333 |
| 4,334,633 | 6/1982 | Piegza | 220/332 |
| 4,391,188 | 7/1983 | Gwathney et al. | 220/1 T |

*Primary Examiner*—George T. Hall

*Attorney, Agent, or Firm*—Shlesinger, Arkwright & Garvey

[57] ABSTRACT

A bustle gate pivot mechanism includes a multisided container. A first seal is disposed about a first end portion of the container. A first pivot mechanism is connected to a first one of the sides and includes a first link extending therefrom and pivotally connected thereto. A second pivot mechanism is connected to the first link at a distance from the first pivot mechanism and is pivotal therewith and includes a second link extending therefrom and pivotally connected thereto. A bustle gate is connected to the second link at a distance from the second pivot mechanism and is pivotal therewith. A second seal is disposed about the gate. The gate is pivotal about the second pivot mechanism for selectingly engaging and disengaging the first and second seals. The gate and the first link are furthermore pivotal about the first pivot mechanism for selectively positioning the gate proximate to and remote from the first end portion.

20 Claims, 3 Drawing Sheets

FIG 1
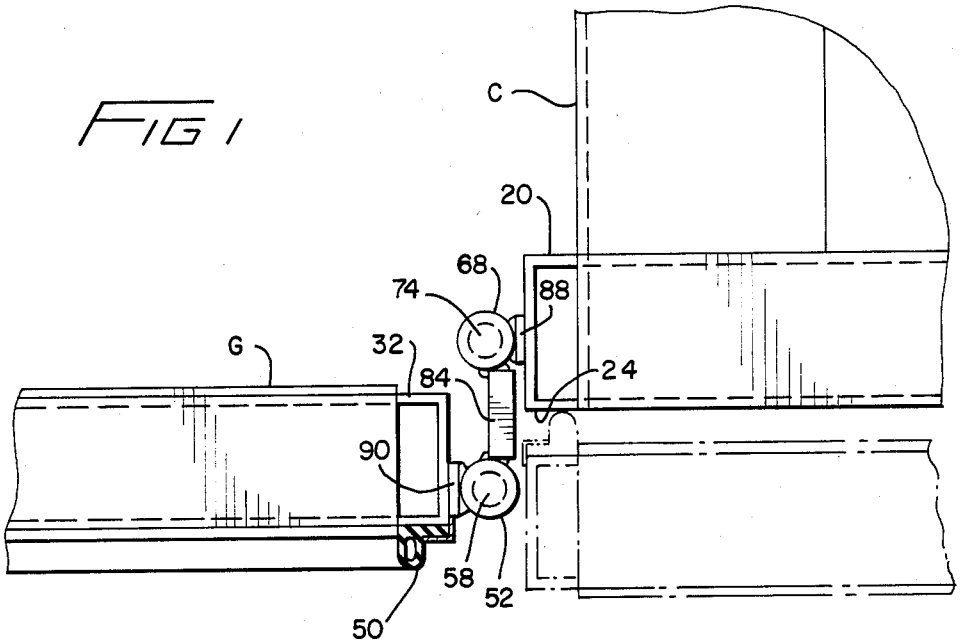
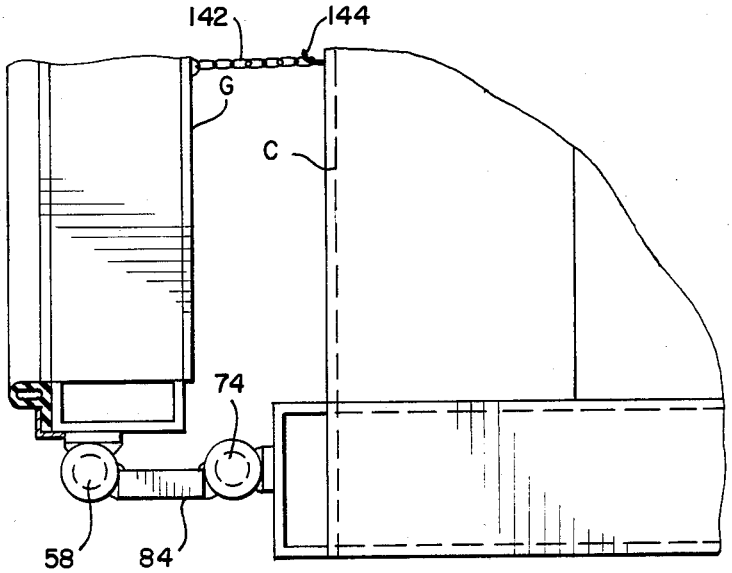
FIG 2

BUSTLE GATE ASSEMBLY AND METHOD

BACKGROUND OF THE INVENTION

A waste compactor is a hydraulically operated device which compresses waste in order to minimize the disposal costs thereof. Usually, a compactor has a container in which the waste is compacted and has a movable ram for transferring waste from a charge box into the container and for then compressing the waste therein. The charge box is usually at one end of the container and a door is at the opposite end and through which the compacted waste is removed when the container is full. Conventional operating procedure is to disconnect the compactor/container from the hydraulic unit and to haul the filled compactor/container to a refuse collection center where the container is emptied.

The waste container unit normally is transported by truck and the like between the waste receiving center and the compactor operating site. This transportation requires that the container and its related assemblies comply with applicable state and federal statutes and regulations with regard to highway transportation, among others. For example, there are regulations which control the width of a body transported on the highway by a vehicle.

A bustle gate is a door which is pivotally secured to the container to increase the amount of waste and the density of waste in the container. A bustle gate closes the waste-emptying opening of the container. The bustle gate has an arcuate portion facing into the container which causes the waste to be redirected during the compactor operation. The redirection is such that the waste is changed from flowing to the gate to flowing away from the gate. This redirection is effectuated by means of arcuate plates and the desirable benefit is that the density of the waste increased, thereby itating less frequent dumping, and the amount of waste is correspondingly increased.

Bustle gates have been used in the past on compactors. Typically, the gate has been pivotally connected along a top edge of the container and has been pivoted by means of a hydraulic mechanism. Such mechanisms can be complicated, necessitating a power supply and the like, and they also unnecessarily increase the height of the container and thereby limit passage under bridges and the like.

The compactor frequently contains a quantity of fluid waste requiring that the bustle gate be sealingly engaged with the container to prevent seepage of the waste. A typical side pivot assembly, such as provided by an hinge, has the undesirable effect of destroying the resilient rubber seal upon repeated operation of the gate. This is because the bustle gate has a rather substantial depth, as compared with a typicaI door, with the result that the resilient seal is progressively pushed from the hinge side to the latch side as the gate is pivoted into the closed position, with the result that the seal frequently tears. Such tearing may also occur with a conventional flat door.

In view of the above, there is a need for a bustle gate pivot mechanism which does not substantially increase the dimensions of the container. Furthermore, such a pivot mechanism should avoid the need for hydraulically operated mechanisms. Lastly, a good pivot mechanism should assure that the resilient seal is not torn upon repeated use of the gate. The disclosed invention meets these requirements by providing a pivot mechanism employing dual pivots for pivoting the gate on a first axis and then on a second parallel axis.

OBJECTS AND SUMMARY OF THE INVENTION

The primary object of the disclosed invention is to provide a bustle gate pivot mechanism which permits side pivoting of the bustle gate without requiring the use of hydraulic mechanisms or ratcheting hinge slide mechanisms and in a manner which maintains the integrity of the resilient seal throughout repeated use.

The disclosed invention is a bustle gate pivot mechanism for a multisided waste container. First seal means are disposed about a first end portion of the container and first means are connected to a first one of the sides. A first link extends from and is pivotally connected to the first means and a second means is connected to the first link means and is pivotal therewith and includes second link means extending therefrom and pivotally connected thereto. The bustle gate is connected to the second link means and is pivotal therewith. A second resilient seal is disposed about the gate whereby the gate is pivotal about the second means for selectively engaging and disengaging the first and second seal means and the gate and the first link means are pivotal about the first means for selectively positioning the gate proximate to and remote from the first end portion.

The waste container has an open discharge end opposite the charge box end and the bustle gate is pivotally connected along one vertical side to this open end. A ratchet latching mechanism is on the opposite side of the open end and selectively secures and releases the gate. The open end has a peripheral flange which is continuous thereabout and defines the first seal. A resilient seal is affixed to the gate about the lower half thereof and is engageable with the flange for making a liquid-tight connection therewith. The double axis pivot assembly is such that the gate first pivots 180° so as to be disposed parallel to the plane of the flange and then is pivoted 90° so as to be disposed generally transverse to the plane of the flange. The gate is closed by a reverse pivoting operation which minimizes the distortion of the seal because the seal approaches the flange generally transverse to the face thereof.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a fragmentary top plan view partially in section disclosing the pivot mechanism of the invention and with pivoting indicated by broken lines;

FIG. 2 is a view similar to FIG. 1 with the gate pivoted 90° from the position of FIG. 1;

DESCRIPTION OF THE INVENTION

Figure 3:
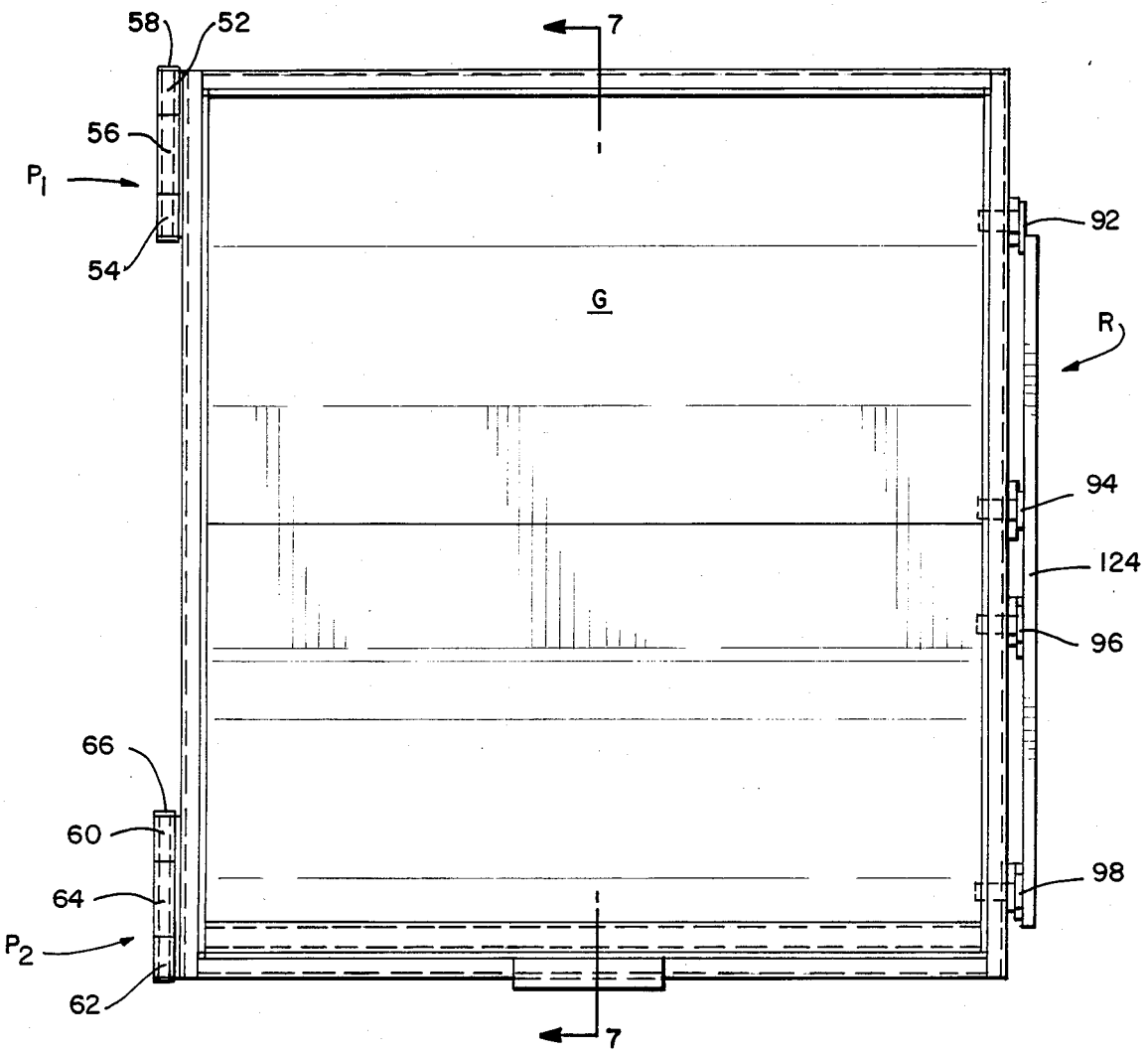
FIG. 3 is a front elevational view of the invention.
Figure 4:
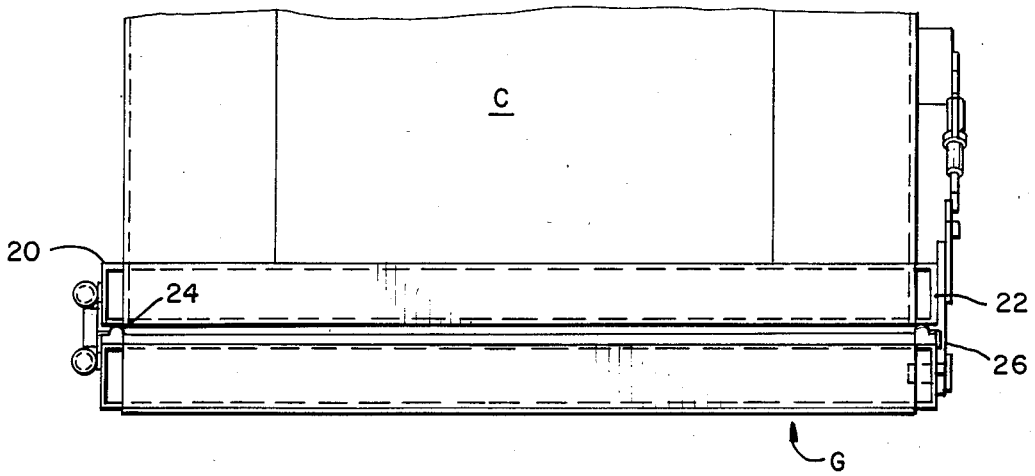
FIG. 4 is a fragmentary top plan view of the invention of FIG. 3.

Waste container C, as best shown in FIG. 4, is, preferably, a steel container having a rectangular discharge opening, although the container body may be octagonal and which container has a charge box (not shown) at one end and a bustle gate G at the opposite end thereof. Bustle gate G, as best shown in FIG. 3, is pivotally connected to container C by first and second pivot mechanisms P1 and P2, respectively, as herein further explained. Ratchet latch mechamism R is disposed along a side of the container C opposite to the pivot mechanisms P1 and P2 and selectively releases and secures the gate G to the container C.

Figure 7:
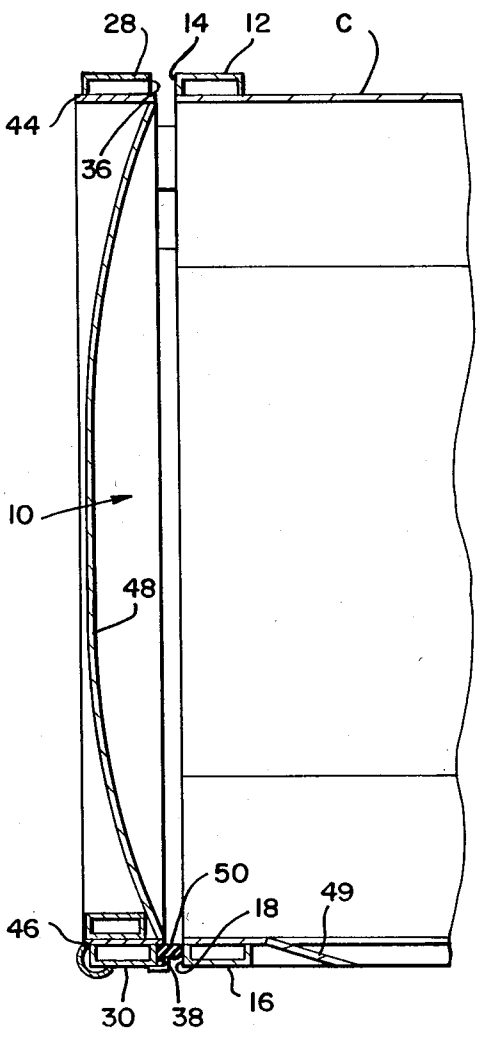

As best shown in FIG. 7, container C has a first open discharge end 10 through which waste is removed when the container C is full. A box beam 12 extends along the top of container C and has a forward face 14 aligned with the end of the container. A similar box beam 16 extends along the bottom of container C and has a corresponding forward face 18. As best shown in FIG. 4, correspondingly similar and aligned box beams 20 and 22 are disposed upon opposite sides, of the container C and the beams 20 and 22 are secured, to the beams 12 and 16. The beams 20 and 22 likewise have corresponding forward faces 24 and 26, respectively, which lie on the same common plane as the forward faces 14 and 18 of the box beams 12 and 16, respectively. The box beams 12, 16, 20 and 22 are secured together, by welding and the like, so that the forward faces 14, 18, 24 and 26 thereof provide a continuous and uninterrupted flange which is a sealing surface, for reasons to be explained further.

Bustle gate G includes a top box beam 28 as well as a bottom box beam 30, eaCh of which is in alignment with the adjacent beam 12 and 16, respectively, Similar box beams 32 and 34 extend along the sides of the gate G and are likewise in alignment with the box beams 20 and 22, respectively. The box beams 28, 30, 32 and 34 have corresponding rear faces 36, 38, 40 and 42, respectively. The faces 36, 38, 40 and 42 are in spatial alignment with the faces 14, 18, 24 and 26 respectively. FIG. 7 discloses longitudinally extending plates 44 and 46 to which the beams 28 and 30 are secured, respectively, by welding and the like. It can be noted that the plates 44 and 46 have a length exceeding the length of the respective beams 28 and 30. Lengthwise, the beams are longer. Widthwise, the plates are wider.

Arcuate plate 48 is secured to the plates 44 and 46, as well as to the corresponding side beams 32 and 34, as best shown in FIG. 7. The plate 48 has a curvature which is rather flat and the center thereof is directed forwardly into or beyond the container C. The result is that waste moved into the container C by the compactor ram is directed along deflector plate 49 and from there onto the plate 48 and is therewith caused to follow along the plate 48 upwardly and subsequently to be redirected back into the container C by the upper portion of the plate 48. The plate 49 in the floor of container C starts the waste moving upwardly. The result is that the waste achieves a greater compacted density than can be achieved with a conventional door. Because of the greater density, then more waste can be received in the container C without necessitating dumping.

FIG. 7 also discloses the resilient rubber seal 50 which is secured to the rear faces 36, 38 and 40 of the gate G and which sealingly engages with the forward faces 18, 24 and 26 of the container C. The seal 50 is, preferably, manufactured from a high compression styrene butadiene which resists oil and chemicals. The seal 50 extends in continuous and uninterrupted fashion about the lower half of gate G and thereby avoids broken spots which could cause the leak of fluid from the container. Certainly, the seal 50 could extend around the entirety of gate G.

As previously noted the resilient door seal of a conventional door, particularly a deep door, which corresponds with seal 50 of the bustle gate G, is subjected to relatively high lateral forces during closing. These lateral forces result from the fact that the seal extending along the door nearest the pivot assemblies is first engaged with the container seal surface and progressively moves along in side-wise manner as the door is closed. The result is that the resilient seal adjacent the hinge mechanism is frequently subjected to such strong forces that the seal may be distorted, torn or otherwise cease to function.

Figure 5:
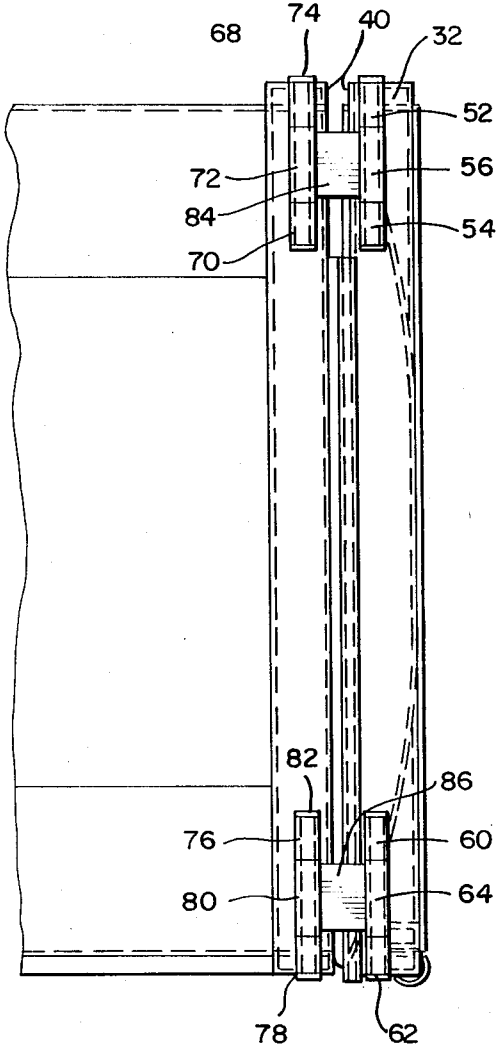
FIG. 5 is a fragmentary side elevational view of the pivot mechanism of the invention.

The pivot mechanisms P1 and P2, as illustrated in FIGS. 3 and 5, are uniquely designed to minimize the lateral closing forces on the seal 50 and thereby extend the operational life of the seal 50 of the bustle gate G.

As best shown in FIG. 3, fixed tubes 52 and 54 are secured to the bustle gate G in spaced apart coaxial relation. A pivot tube 56 is positioned between the fixed tubes 52 and 54 and pintle 58 extends through the aligned apertures of the tubes 52, 54 and 56 so that tube 56, and thereby gate G, may pivot relative to tubes 52 and 54. Similarly, fixed tubes 60 and 62 are disposed in spaced apart coaxial relation at the bottom of gate G. A pivot tube 64 is disposed between and is in coaxial alignment with the fixed tubes 60 and 62. Pintle 66 extends through the apertures of the tubes 60, 62 and 64. The pintles 58 and 66 are coaxial and thereby define a pivot axis about which the bustle gate G rotates for causing the seal 50 to be selectively engaged and disengaged from the forward faces 18, 24 and 26.

Fixed tubes 88 and 70 are secured to the container C along a first side thereof in spaced apart coaxial relation, preferably in alignment with the fixed tubes 52 and 54 respectively, as best shown in FIG. 5. A pivot tube 72 is disposed between the fixed tubes 68 and 70 and pintle 74 extends through the aligned apertures of the tubes 68, 70 and 72. Similarly, fixed tubes 76 and 78 are disposed in spaced apart coaxial relation and are secured to the container C at the bottom thereof. A pivot tube 80 is disposed between the tubes 76 and 78 and pintle 82 extends through the aligned apertures of the tubes 76, 78 and 80. The pintles 74 and 82 are in coaxial alignment and define another pivot axis. Therefore the pintles 74 and 82 define a first pivot axis while the pintles 58 and 66 define a second parallel pivot axis.

A first rectangular bar or link 84 is secured to and extends between the pivot tubes 72 and 56. A similar bar 86 is secured to and extends between the pivot tubes 80 and 84. Preferably, the bars 84 and 86 are disposed in the same plane. The bars 84 and 86 connect the bustle gate G with the container C with the result that the gate G is free to pivot about the first pivot axis and to then subsequently pivot about the second pivot axis, as will be further explained.

As best shown in FIG. 1, first link or support 88 is secured to the fixed tube 68 and to the box beam 20 for maintaining the fixed tube 68 in proper alignment. Those skilled in the art will appreciate that similar links 88 are provided for each of the tubes 70, 76 and 78 and serve to secure the fixed tubes relative to the beam 20. A corresonding link 90 is secured to the fixed tube 58 and to the beam 32, for like reason. Similarly, corresponding links 90 secure each of the tubes 54, 60 and 62 to the gate G. In this way, the gate G and the container C are operably interconnected by the pivot mechanisms P1 and P2. It can also be noted in FIG. 1 that the tubes 68 and 52 are disposed at the opposite ends of the rectangular bar 84 which extend therebetween.

Figure 6:
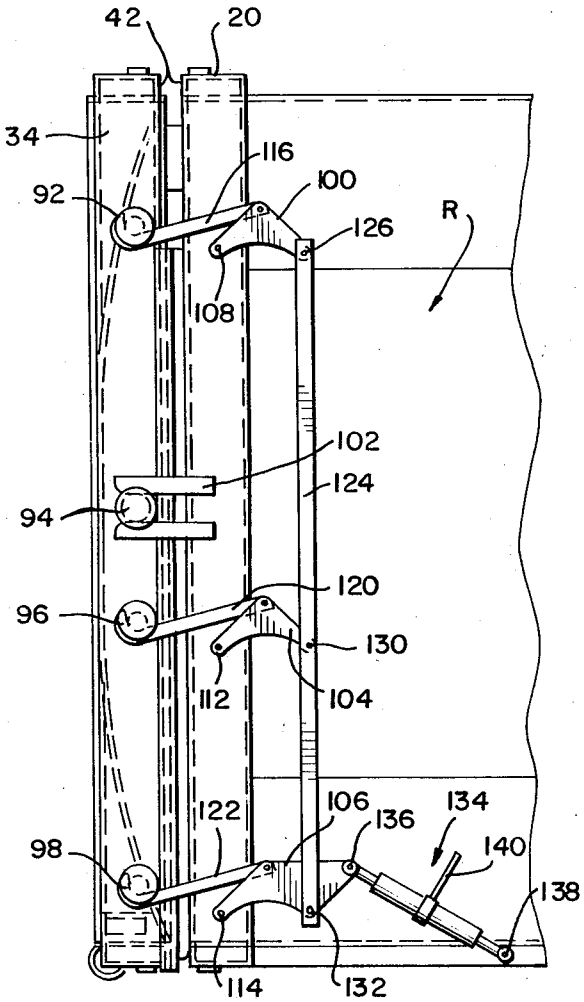
FIG. 6 is a fragmentary side elevational view of the ratchet latching mechanism of the invention; and, FIG. 7 is a fragmentary cross-sectional view through the bustle gate of the invention.

Tubes or pipes 92, 94, 96 and 98, as best shown in FIGS. 3 and 6, extend outwardly from gate G in spaced parallel relation. The tubes 92, 94, 96 and 98 extend outwardly from box beam 34 adjacent a second side of container C.

Links 100, 104 and 106 are pivotally connected to beam 20 and rotate about pivot points 108, 112 and 114, respectively. Hooks 116, 120 and 122 extend from the links 100, 104 and 106, respectively, and are engageable with the tubes 92, 98 and 98, respectively. Vertical riser 124 is connected to each of the links 100, 104 and 106 and is pivotal therewith about pivot points 126, 130 and 132, respectively. Consequently, upward movement of riser 124 causes the links 100, 104 and 106 to pivot so that the hooks 116, 120 and 122, respectively, disengage from the tubes 92, 96 and 98, respectively. Likewise, downward movement of riser 124 causes the hooks to engage the respective tubes and thereby secure and seal the gate G to the container C. Those skilled in the art will understand that the pipe 94 serves as a guide pin for gate G and is received within the opening of guide plate 102.

Ratchet 134 has a first end pivotally connected at 136 to link 106 and a second end connected at 138 to container C. The ratchet 134 operates such that movement of handle 140 cause the link 106 to be associatively pivoted with the result that the riser 124 is selectively vertically moved in response to movement of handle 140. In this way, movement of handle 140 causes the hooks 116, 120 and 122 and the guide plate 102 to be selectively engaged and disengaged from the respective tubes 92, 96, 98 and 94.

As best shown in FIG. 2, chain 142 is secured to gate G at a first end thereof. A second end thereof is engaged with hook 144 secured to container C. The chain 142 when engaged with the hook 144 thereby prevents the gate G from pivoting from the fully open position disclosed in FIG. 2. Those skilled in the art will understand that the chain 142 and hook 144 are positioned toward one side of gate G to permit convenient access.

Those skilled in the art will appreciate that the container C has longitudinally extending sides, to one of which the pivot mechanisms P1 and P2 are operably associated and to an opposite one of which the ratchet mechanism R is associated. The gate G is, in the closed position of FIG. 3, disposed generally transverse to the sides of the container C. When the container C must be emptied, then the gate G is pivoted by pivot mechanisms P1 and P2 on the first and second pivot axes so as to extend parallel to these sides, as best shown in FIG. 2.

OPERATION OF PIVOT MECHANISMS

The bustle gate G of the invention is side hinged and therefore has no inherent or gravitational movement capability. This is to be contrasted with the top hinged gates of other container assemblies and avoids a potential safety problem of sudden unexpected movement. The bustle gate G of the invention will remain in one position after being moved there by the operator and does not require any hydraulic or similar mechanical assistance to accomplish the pivoting. Likewise, the ratchet mechanism R is hand-operated and avoids the needs for hydraulic assemblies and the like.

Pivoting of the bustle gate G by an angular amount of 270° Can be accomplished simply and without difficulty because of the pivot mechanisms P1 and P2, each of which has the aligned first and second pivot axes defined by the respective pintles. Opening of the gate G from its sealing closed position with the container C first requires that the hooks 116, 120 and 122 be disengaged from the respective tubes 92, 96 and 98. The gate G may then be pivoted about the first pivot axis defined by the pintles 58 and 66 so that the pipe 94 disengages from plate 102 with the result that the gate G rotates 180° into the position shown in FIG. 1. It can be noted in FIG. 1 that the gate G extends generally transverse to the longitudinal sides of the container C. The gate G may then be pivoted about the second axis defined by the pintles 74 and 82 and then disposed in the fully opened position shown in FIG. 2. In this position, the gate G extends parallel to the sides of the container C. It can also be noted in FIG. 2 that the bar 84 has also pivoted with the gate G because of the interconnection of the pivot tubes 56 and 72.

Closing of the gate G is likewise accomplished in straightforward manner. The chain 142 is removed from the hook 144 and the gate G and the bars 84 and 86 may then be pivoted about the second axis into the position shown in dark lines in FIG. 1. It can be noted in FIG. 1 that the bar 84 extends parallel to the sides of the container C. The gate G may then be pivoted 180° about the first pivot axis from the position shown in dark lines in FIG. 1 to the position shown in phantom lines wherein pipe 94 is located in the opening of plate 102. At that point, the ratchet mechanism 134 may be operated to cause the hooks to engage the respective tubes and thereby secure the bustle gate G to the container C.

The double pivot mechanism of the invention minimizes the lateral forces exerted on the seal 50 by the closing of the gate G. This is because the seal 50 adjacent the first pivot axis of the pivot mechanisms P1 and P2 engages the face 24 only shortly before the seal 50 engages the face 26. This is due to the fact that the gate G pivots about the first pivot axis such that the seal 50 moves essentially transverse to the forward faces of the box beams just before engagement therewith.

Those skilled in the art understand that the bustle gate G is deeper than the usual tailgate which oloses a container C. The double pivot mechanism of the invention provides the important function of allowing the relatively deep tailgate G to open 270° and also to lie flat against the container side when opened. The geometric location of the pivots defined by the first and second pivot axes allows the seal 50 to be compressed when the ratchet R is tightened while also allowing the tailgate G to be repeatedly opened and closed without damaging the seal 50. The pivot mechanisms P1 and P2 are very compact and therefore permit the container C to have more usable width than would be expected with a bustle gate having side hinges.

The first pivot axis must be located close to the seal 50 for the preferred seal contact to occur with the forward faces of the box beams. The length of the bars 84 and 86 and the location of the second pivot axis are determined by the length that the bustle gate G extends beyond the first pivot axis.

While this invention has been described as having a preferred design, it is understood that it is capable of further modifications, uses and/or adaptations of the invention following in general the principle of the invention and including such departures from the present disclosure has come within known or customary practice in the art to which the invention pertains, and as may be applied to the central features hereinbefore set forth, and fall within the scope of the invention of the limits of the appended claims.

What I claim is:

1. A bustle gate pivot mechanism, comprising:

(a) a multisided container;

(b) first seal means disposed about a first end portion of container;

(c) first means connected to first one of said sides and including first link means extending therefrom and pivotally connected thereto;

(d) second means connected to said first link means at a distance from said first means and pivotal therewith;

(e) gate means operably connected to said second means and pivotal therewith; and, (f) second seal means disposed about said gate means whereby said gate means is pivotal about said second means for selectively engaging and disengaging said first and second seal means and said gate means and said first link means are pivotal about said first means for selectively positioning said gate means proximate to and remote from said first end portion.

2. The mechanism of claim 1, wherein:

(a) said second seal means being continuous and uninterrupted.

3. The mechanism of claim 1, wherein:

(a) said first seal means including a flange extending about said first end portion; and, (b) said second seal means being resilient for compressively engaging with said flange.

4. The mechanism of claim 3, wherein:

(a) a box beam extending along each of said sides and each box beam including a first face;

(b) said beams being interconnected and aligned so that said first faces lie on the same plane and provide a continuous flange about said first end portion.

5. The mechanism of claim 1, wherein:

(a) said gate means including a bustle gate comprising an arcuate portion facing into said container when said first and second seal means are engaged.

6. The mechanism of claim 1, further comprising:

(a) first latch means extending from a second side of said container; and, (b) second latch means extending from said gate means and engageable with said first latch means for securing said gate means to said first end portion.

7. The mechanism of claim 6, wherein:

(a) said first latch means including ratchet means having a pivotal latch portion and means for pivoting said latch portion; and, (b) said second latch means including pipe means whereby operation of said pivot means causes said latch means to be selectively engaged and disengaged from said pipe means.

8. The mechamism of claim 7, wherein:

(a) flexible link means extending from one of said first side and said gate means; and, (b) first catch means extending from the other one of said gate means and said first side engageable with said flexible link means for preventing pivoting of said gate means about said second means.

9. The mechanism of claim 6, wherein:

(a) said first and second sides being oppositely disposed.

10. The mechanism of claim 1, wherein:

(a) said first means including a first pintle receiving member secured to said first side;

(b) said first link means including a second pintle receiving member coaxially aligned with said first pintle receiving member;

(c) a first pintle positioned in said first and second pintle receiving members;

(d) said second means including a third pintle receiving member;

(e) said first link further including a fourth pintle receiving member coaxially aligned with said third pintle receiving member; and, (f) a second pintle positioned in said third and fourth pintle receiving members.

11. The mechanism of claim 10, wherein:

(a) said first and second pintles defining parallel axes.

12. The mechanism of claim 10, wherein:

(a) said second and fourth pintle receiving members being drsposed at opposite ends of said first link means.

13. A bustle gate container, comprising:

(a) a multisided hollow container with a first open end;

(b) first seal means disposed about said first end;

(c) first and second first pivot means connected to a first side of said container and said first pivot means spaced apart along said first side and defining a first pivot axis and each first pivot means including first link means extending therefrom and pivotally connected thereto for pivoting about said first axis;

(d) third and fourth second pivot means, each of said second pivot means connected to one of said first link means and pivotal therewith and said second pivot means defining a second pivot axis parallel to said first pivot axis;

(e) a bustle gate connected to said second link means and pivotal therewith and including an inner arcuate portion for engagement with and causing redirection of waste in said container during compaction thereof;

(f) second seal means disposed about said gate in alignment with said first seal means whereby said gate pivots about said second axis for causing selective engagement and disengagement of said first and second seal means and further pivots about said first axis for being selectively disposed adjacent to and away from said first end; and, (g) latch means connected to a second side of said container and engageable with said gate for selectively securing and releasing said gate.

14. The container of claim 13, wherein:

(a) said first seal means including a flange member extending in continuous and uninterrupted manner; and, (b) said second seal means including a resilient element extending in continuous and uninterrupted manner.

15. The container of claim 13, wherein:

(a) said latch means including a pivotal latch member having a first latched position and a second released position; and, (b) second latch means extending from said gate engageable with said first mentioned latch means.

16. The container of claim 15, wherein:

(a) flexible link means being associatced with one of said gate and said first side; and, (b) catch means being secured to the other one of said gate and said first side engageable with said flexible link means for securing said gate in a preselected position.

17. The container of claim 13, wherein:

(a) a box beam being secured to each of said sides at said first end, said beams each having a forward face providing said first seal means and said beams being interconnected and uninterrupted so that said forward faces lie on a common plane; and, (b) said gate extending generally transverse to said plane when said gate is pivoted on said first axis away from said first end.

18. The container of claim 13, wherein:

(a) said first link means including a rectangular bar and said first and second pivot means being disposed at opposite ends of said bar.

19. The container of claim 13, wherein:

(a) each of said first and second pivot means including a first and second spaced apart hinge part and a third hinge part being disposed between said first and second hinge parts;

(b) each of said hinge parts having an aperture therethrough aligned with the respective pivot axis; and, (c) a pintle positioned in each of said apertures.

20. The method of opening a bustle gate pivotally secured to one side of the open end of a waste container, comprising the steps of:

(a) pivoting said gate on a first axis so that said gate extends generally parallel to said open end; and, (b) pivoting said gate on a second axis parallel to said first axis so that said gate extends generally transverse to said open end.

* * * * *

UNITED STATES PATENT AND TRADEMARK OFFICE

CERTIFICATE OF CORRECTION

PATENT NO. : 4,741,455

DATED : May 3, 1988

INVENTOR(S) : James K. Robbins

It is certified that error appears in the above-identified patent and that said Letters Patent is hereby corrected as shown below:

Column 7, Claim 1, subparagraph (b):

(b) first seal means disposed about a first end portion of said container;

Column 7, Claim 1, subparagraph (c):

(c) first means connected to a first one of said sides and including first link means extending therefrom and pivotally connected thereto;

Signed and Sealed this

Seventeenth Day of January, 1989

*Attest:*

*Attesting Officer*

DONALD J. QUIGG

*Commissioner of Patents and Trademarks*